US005467626A

United States Patent [19]

Sanders

[11] Patent Number: 5,467,626

[45] Date of Patent: Nov. 21, 1995

[54] INTEGRAL FORMING DIE SYSTEM FOR SUPERPLASTIC METAL FORMING

[75] Inventor: Daniel G. Sanders, Sumner, Wash.

[73] Assignee: The Boeing Company, Seattle, Wash.

[21] Appl. No.: 130,545

[22] Filed: Oct. 1, 1993

[51] Int. Cl.[6] ..... B21D 26/02

[52] U.S. Cl. ..... 72/60; 72/709

[58] Field of Search ..... 72/57, 60, 709

[56] References Cited

U.S. PATENT DOCUMENTS

| | | | |
|---|---|---|---|
| 1,855,855 | 4/1932 | Gillis et al. . | |
| 2,282,155 | 5/1942 | Bandur | 18/34 |
| 3,974,673 | 8/1976 | Fosness et al. | 72/38 |
| 4,145,903 | 3/1979 | Leach et al. | 72/60 |
| 4,301,584 | 11/1981 | Dillner et al. | 29/156.8 |
| 4,526,312 | 7/1985 | Goss et al. | 228/157 |
| 4,577,797 | 3/1986 | Raymond | 228/118 |
| 4,584,860 | 4/1986 | Leonard | 72/61 |
| 4,706,361 | 11/1987 | Meyer et al. | 29/423 |
| 4,765,166 | 8/1988 | Bergman et al. | 72/60 |
| 4,824,373 | 4/1989 | Okada et al. | 433/200 |
| 4,889,276 | 12/1989 | Cadwell et al. | 228/265 |
| 4,901,552 | 2/1990 | Ginty et al. | 72/60 |
| 4,984,348 | 1/1991 | Cadwell | 29/423 |
| 5,016,805 | 5/1991 | Cadwell | 228/118 |
| 5,209,093 | 5/1993 | Cadwell | 72/60 |
| 5,214,949 | 6/1993 | Cadwell | 72/60 |
| 5,277,045 | 1/1994 | Mahoney et al. | 72/60 |

*Primary Examiner*—David Jones

*Attorney, Agent, or Firm*—John C. Hammar; J. Michael Neary

[57] ABSTRACT

A free standing, self-supporting ceramic superplastic forming die assembly having a configuration that provides sufficient strength to resist a compressive load exerted by a press to hold a die lid on a die body against an oppositely directed force generated by gas at superplastic forming pressures within the die, and provides sufficient tensile strength, when under pressure of compressive loads exerted by the press to resist internal bursting force exerted by gas at superplastic forming pressures within the die, thereby making possible the use of a ceramic die for superplastic forming applications without the need of a surrounding containment pressure vessel.

22 Claims, 4 Drawing Sheets

Fig. 1
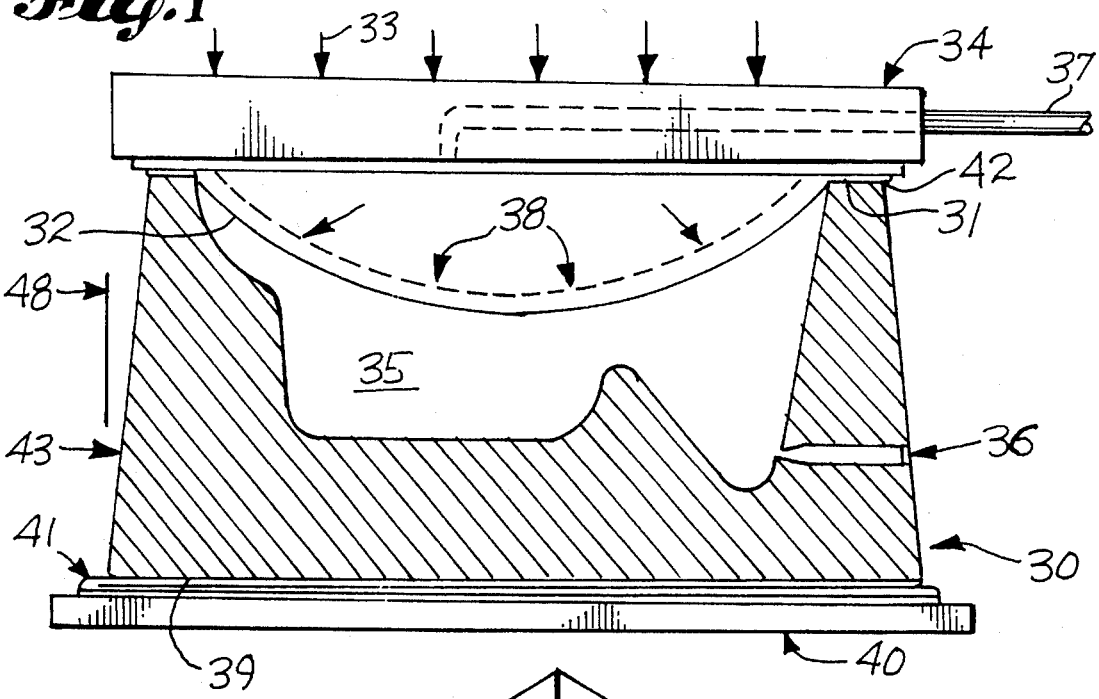
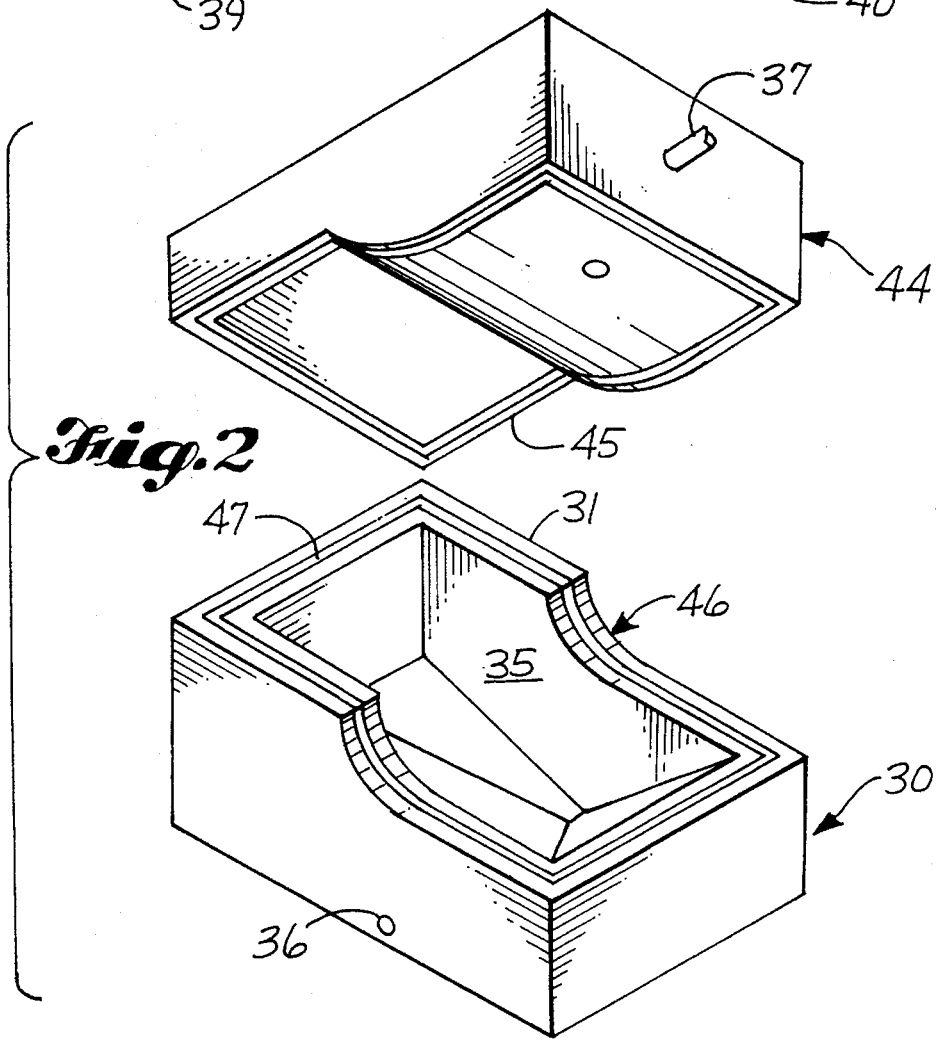
Fig. 2

INTEGRAL FORMING DIE SYSTEM FOR SUPERPLASTIC METAL FORMING

BACKGROUND OF THE INVENTION

This invention relates to superplastic forming of sheet metal using a self supporting ceramic superplastic forming die, and more particularly to a ceramic forming die which provides for catastrophic decompression control, peripheral system integration, leak prevention where die penetration is desired, and non-coplanar contact surface geometry. Additionally, this invention relates to damage tolerant contact surfaces for ceramic dies, and to superplastic forming processes using ceramic dies to provide various advantages such as part cavitation prevention.

Superplastic forming is well known and is used throughout the aerospace industry as well as in other industries to form sheets of titanium, steel, and aluminum. Prior to the superplastic forming process, these forming operations were often performed using lead hammer forming. This process uses a lead punch or hammer to drive the material to be formed, the "workpiece," into a forming die. The punch and die are not only expensive to make, but also environmentally undesirable both because the process is extremely noisy, and because it created airborne heavy metal and lead dust. The advent of superplastic forming has allowed a great many parts formerly produced using lead dies to be produced using less environmentally adverse die materials in a far quieter process. Thus, facilitating the transition from archaic hammer forming techniques to superplastic forming would be extremely useful for the industry.

Superplasticity is a metal's capability at certain temperatures and strain rates to exhibit very high elongation rates while avoiding localized thinning. At the limits of traditional forming processes the work piece ceases to elongate uniformly and begins to deform in discreet places. This tendency is generally referred to as "necking" and is undesirable because a work piece which has necked down in a specific location will be more prone to fail prematurely at that location when put under load. A superplastically formed part may both avoid localized necking and undergo far greater elongation than otherwise possible. This increased elongation makes forming more complex parts possible. It also makes possible a reduction of part count by integrating multiple parts, which conventionally would be riveted into one assembly, into a single superplastically formed part.

The superplastic forming process may be combined with diffusion bonding, laser welding, or resistance welding to produce complex sandwich structures under superplastic conditions. Diffusion bonding refers to the process of laminating two or more sheets of superplastically formable material together with the bonds typically only occurring in a discrete pattern such as a lattice. During the forming process, gas pressure is applied between the sheets to push them apart where they are not bonded. The resulting part, a truss core sandwich, consists of two or more sheets supported internally by diagonal braces. This process creates parts with design features never achieved prior to the combination of superplastic forming and diffusion bonding. Laser and resistance welding are substantially similar to diffusion bonding in that, before forming, multiple sheets of material are welded together at discrete locations using the laser welding process rather than diffusion bonding. After welding, a truss core sandwich can be produced using superplastic forming.

Superplastic forming dies are typically made of corrosion resistant steel (CRES) in order to withstand the high temperature and pressure associated with superplastic forming. While CRES is very durable and has been a useful material for superplastic forming dies, machining CRES dies is very time consuming and expensive. A great deal of effort has gone into finding replacement material for CRES in superplastic forming dies, directed primarily toward the use of ceramics in superplastic forming dies. Prior efforts have included a wide range of improvements from simply using a ceramic male insert in a CRES die to using a CRES containment vessel with the entire formed shape made from a ceramic insert.

Ceramic forming dies have been a great asset in developing die configurations. It is possible to avoid committing the resources necessary to make a CRES production superplastic forming die until the die geometry has been fully developed using ceramic dies in an external pressure vessel. The ideal superplastic prototype forming die would wholly eliminate the use of CRES and avoid the associated machining costs, material waste, and part size limitations created by pressure vessels.

Among the reasons for pursuing the use of free standing ceramic forming dies is both that ceramic is far less expensive to fabricate than CRES, and that, unlike CRES, ceramic die forming and disposal pose little environmental impact. However, prior art ceramic dies necessitated a pressure vessel to prevent the die from bursting when subjected to superplastic forming pressure. See e.g. Caldwell, U.S. Pat. No. 5,016,805. A containing pressure vessel would have to be machined from CRES and then either inserted into a hydraulic forming press, or fitted with a complex securing method to insure proper support of the internal ceramic forming die. See e.g. Leonard, U.S. Pat. No. 4,584,860. Dedicating die space to the pressure vessel limits the maximum part size. Furthermore, pressure vessels restrict the die periphery to a certain shape which defines the initial work piece size and may consequently result in considerable material waste. A superior die arrangement would allow the die to take whatever external shape was best suited to the particular part to formed.

External pressure vessel use protects die operators from injury caused by potentially explosive decompression in the event of failure of the ceramic die. The forming die may experience a dramatic pressure spike if the work piece ruptures or tears out while being formed, especially if high differential pressure is being applied to form the work piece. In such event, a sudden increase of pressure will occur in the die, subjecting it to substantial impact stress. The pressure vessel was perceived to be necessary in part because of the potential for uncontrolled catastrophic die failure and because of the concomitant inability to insure controlled release of superplastic magnitude pressures that could result from pressure spikes during the superplastic forming process. This unpredictable die failure potential was believed to make use of self supporting ceramic dies undesirably hazardous. A preferable solution would eliminate the hazards of ceramic die failure but avoid resorting to the costly and cumbersome pressure vessel solution previously employed.

One factor which has delayed development of a self supporting ceramic superplastic forming die has been the inability to produce a die strong enough to avoid using an external supporting pressure vessel to carry the pressures involved in the forming process. For example, the die must withstand considerable compression force from the press. The press must apply sufficient force to secure the work piece periphery during forming and to seal the die and lid during forming to substantially prevent the escape of gas from the forming cavity. Several companies have devoted considerable time and money in hopes of developing ceramics and methods for making a ceramic die with sufficient strength and durability to survive the superplastic forming process. Unfortunately, no one has been able to achieve breakthroughs that would allow a ceramic superplastic forming die to be used without some sort of pressure vessel. This lack of useful development results principally from ceramic's particular susceptibility to fracture. Prior art ceramic dies are prone to this weakness partly because a large number of minor internal defects in the ceramic result from the prior art die manufacturing method. It would be desirable to develop a method for using existing ceramic material to make a superplastic forming die, yet avoid the necessity of placing that die in a pressure vessel.

A ceramic die's useful life has typically been limited to production of only a few parts; usually on the order of five or fewer, because of rapid die wear. For example, superplastically formed titanium which directly contacts the ceramic die seal surface tends to bond to that surface. When the formed titanium is subsequently removed from the die, a portion of the ceramic material that is bonded to the part is removed with the part. There is no prior art method for extending the die's seal surface life other than machining away a portion of the seal surface to make it sufficiently smooth to again form a proper seal. Ideally, ceramic dies would allow a longer production life by providing a way to protect the contact surface.

The contact surface of prior art superplastic forming dies is coplanar to simplify die sealing and fabrication. There have been some attempts to manufacture CRES dies or pressure vessels with contoured contact surfaces; however, only rarely was it worth the high machining costs to grind dies with contorted contact surfaces with sufficient accuracy that the two non-coplanar contact surfaces achieve a good seal surface. Exacerbating the problem, die creep and thermal distortion create sealing problems in non-coplanar dies after only a few part pressings. This limitation prevented both using a work piece that had some simple forming operation previously performed and using the dies themselves to non-superplastically form the work piece prior to the actual superplastic forming process. This resulted in two equally unsatisfactory alternatives. First, many potential part geometries could not be produced. The work piece contours that would be necessary to both produce the desired part and maintain the work piece periphery in the flat seal surface exceeded the limits of the superplastic process. Second, when production of such parts was attempted, the part would undergo excess thinning or wrinkling and be defective. It would be desirable to design a system with non-coplanar die contact surfaces without creating either high machining costs, or very short die life.

The conduits which do penetrate a ceramic die sometimes allow forming pressure to leak from the forming cavity by passing between outside of the penetrating conduit and the die hole. Various methods have been used to limit this such as swaging the conduit; however, maintaining a pressure tight seal at die penetration points has tended to require an undesirable high labor costs. A preferable technique would provide a simple method for preventing unintended die venting paths while increasing the reliability of such a system.

The current system of using a pressure vessel for ceramic dies is reliable and available, but it is expensive, requires high die maintenance costs, and tends to result in high die storage requirements. While it is conceptually possible to make an interchangeable pressure vessel work with many different ceramic dies, each die would have to be exactingly manufactured to insure proper alignment of pressure conduits, vent holes, quench conduits, power hook-ups, heating conduits, cooling conduits, and thermocouple holes or use of such devices would have to be eliminated. As a result, a specific pressure vessel typically must be dedicated to each die which substantially increases die cost because each die would require its own relatively expensive CRES pressure vessel. A self supporting die that could be inexpensively made for use on short production runs and discarded would substantially reduce die storage requirements. An improved die system that does not require the expensive pressure vessels and storage requirements would be of great benefit to the industry.

While use of ceramic in superplastic forming dies has advanced the art, the constraint of having to place ceramic in a CRES pressure vessel has hampered the rate at which the art could be advanced by making die fabrication more costly and difficult than a self supporting ceramic die would be. The need to use a pressure vessel results in part from fear that superplastic forming pressures could cause a self supporting die to explode unpredictably and cause harm of an unknown degree to both equipment and people. The value of ceramic dies to the industry would also be enhanced if there was a way to extend die life which is shortened by die to part bonding which quickly erodes the die. Superplastic forming use could also be expanded if the die contact surfaces could be shaped to conform more closely to finish part shape rather than be limited to flat contact surfaces. It would also be useful if the pressure differential between die cavities could be more closely controlled to prevent internal work piece cavitation. A superplastic forming die's value would also be enhanced by developing a simple way to not only integrate attachments, fittings, and lines directly into the die, but also prevent lines which penetrate the die from becoming die pressure loss paths.

SUMMARY OF THE INVENTION

Accordingly, an object of this invention is to provide an improved system and method for superplastically forming metal parts, and a superplastic forming die apparatus made entirely from ceramic material which requires no external supporting structure or pressure vessel to successfully superplastically form metal parts.

Another object of this invention is to provide a method for using an unsupported ceramic die for superplastically forming metal parts.

Yet another object of this invention to provide a method for producing a self supporting ceramic die for use in the superplastic forming process.

A further object of this invention is to provide an improved depressurization mechanism that enables the forming dies to undergo unintended potentially catastrophic failure in a predicted manor which is harmless to machine operators or to the die press.

Still another object of this invention is to provide an apparatus and method which offers improved tolerance for non-coplanar die sealing surfaces and facilitates flexibility in post die fabrication pressure conduit positioning.

A still further object of this invention is to provide for the simple integration directly into the die of gas pressure conduits, vent holes, lifting attachments, alignment pins, thermocouple holes, heating elements, power conduits, and such while avoiding the need for any complex system for coordinating the location of the same features with a specific location in a pressure vessel.

Yet another still further object of this invention is to provide a system for sealing conduits which penetrate the ceramic die and may otherwise result in unintended pressure loss along the periphery of said conduits during the superplastic forming process.

Another yet still further object of this invention is to provide a method of equalizing the pressure distribution over the top and bottom of the die that is exerted by the press platens.

These and other objects of this invention are attained in the preferred embodiments disclosed herein of a superplastic forming die assembly having a configuration and ceramic material that provides sufficient compressive strength to resist a compressive load exerted by a press to hold a die lid on a die body against an oppositely directed force generated by gas at superplastic forming pressures within the die, and provides sufficient tensile strength, when under pressure of compressive loads exerted by the press to resist internal bursting forces exerted by gas at superplastic forming pressures within the die.

DESCRIPTION OF THE DRAWINGS

The invention and its attendant objects and advantages will become more clear upon reading the following description of the preferred embodiment in conjunction with the following drawings, wherein:

FIG. 1 is an elevation, partly in section, of a self supporting ceramic superplastic forming die which is used with forming pressures exerted by gas pressure, schematically represented;

FIG. 2 is an isometric view of a self supporting ceramic superplastic forming die with a ceramic lid with non-coplanar seal surfaces.

DESCRIPTION OF THE PREFERRED EMBODIMENT

Figure 3:
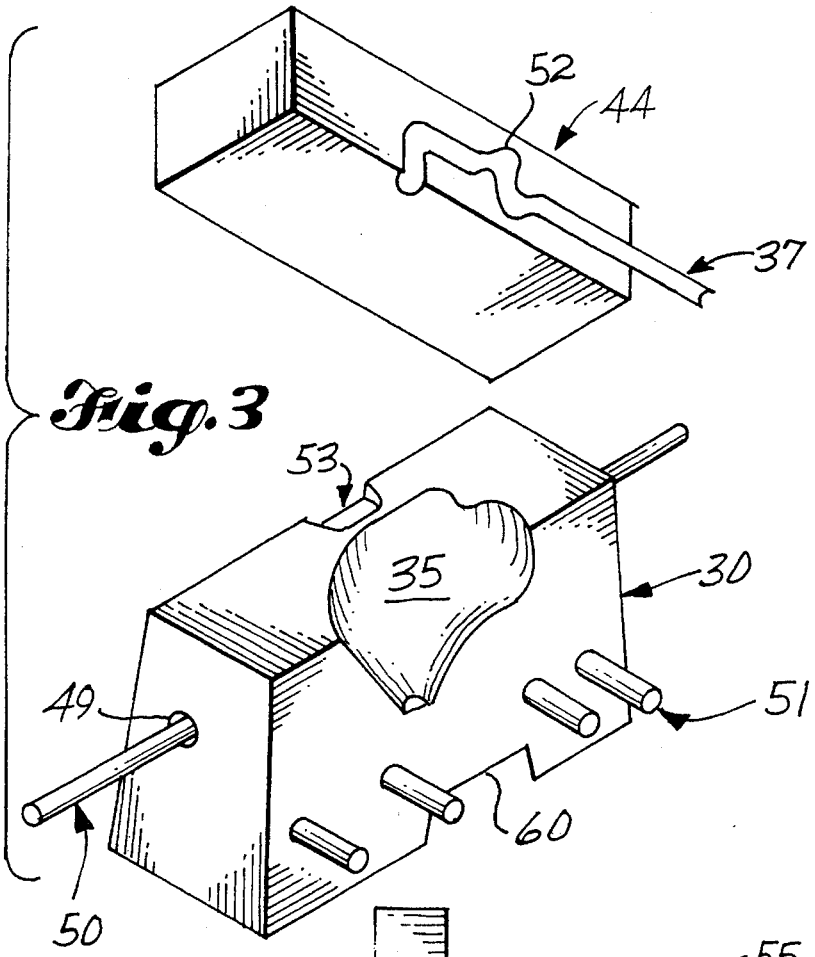
FIG. 3 is an isometric view of a self supporting ceramic superplastic forming die with a ceramic lid having an embedded gas line therein

Turning now to the drawings, wherein like reference characters designate identical or corresponding parts, and more particularly to FIG. 1 thereof, a self supporting ceramic superplastic forming die base 30 is shown having an upper contact surface 31 on which a flat or partially formed work piece 32 has been placed and is held in place by a load 33 applied by a press 55 (shown in FIG. 4) to the die lid 34 and reacted through the lower external surface 39 of the ceramic die base 30. The term "self-supporting" as used herein means a die that is itself strong enough to carry the stresses induced by the press and internal gas pressure at superplastic forming temperatures during the superplastic forming process without the need for an external supporting pressure vessel normally used in prior art ceramic die applications for superplastic forming. The die base 30 has an interior cavity 35 which communicates via a vent hole 36 with the ambient atmosphere to allow gas to escape from the forming cavity 35 during the forming process. The die lid 34 contains a pressure line 37 which conveys pressurized gas into the die under the lid 34 to convey gas under controlled pressure from a gas control system (not shown) for applying forming pressure 38 against the workpiece 32 during the forming process. The die is heated by integral heaters or by heat applied through the platten press and raises the temperature of the workpiece 32 to superplastic temperature at which it may be strained superplastically in a known manner. The superplastic forming process forms the workpiece 32 to the shape of the forming cavity 35.

As shown in FIG. 1, several special measures may be taken in using the ceramic die base 30 to ensure uniform distribution of the pressure exerted by the press platens to hold the lid 34 tightly against the top surface 31 of the die base 30. A one inch steel plate 40, ground flat, should be placed under the die base 30 after final curing and should remain with the die base 30 when it is used. Additionally, a one-quarter inch to one-half inch layer of mortar mix 41 should be cast between the die base's lower external surface 39 and the steel plate 40 to reduce flexural stresses on the die base 30. The best method for curing the mortar mix 41 in place, is to rest the die base 30 on the die lid and apply the mortar mix 41 to the die base's bottom surface 39. Before the mortar mix 41 cures, the steel plate 40 should be placed on top of the mortar mix 41. The entire stack should then be placed between the press platens (not shown) under light load and allowed to cure. This will ensure that, even if the platens are slightly warpped or other imperfections in alignment exist, force from the press (not shown) during forming will be very evenly applied at the contact surface, thereby avoiding localized stress concentrations which could initiate cracks and die collapse. To further protect the die base 30 from flexural stresses, both the die base's lower external surface 39, and the contact surface 31 are precision ground to mate with the press surface (not shown) and the CRES die lid 34 respectively.

Figure 4:
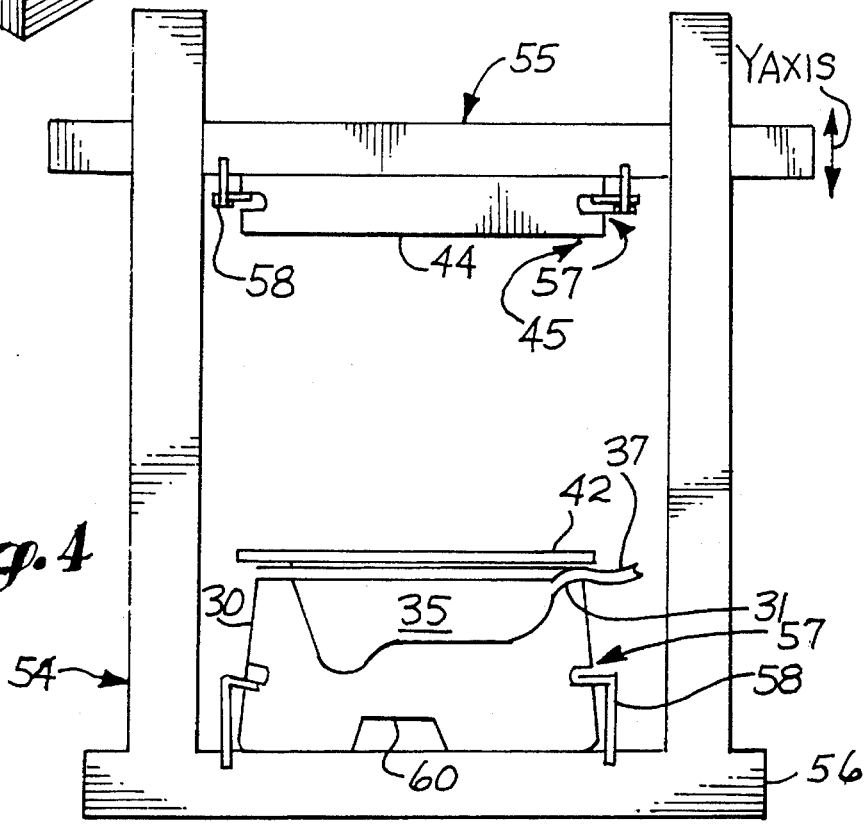
FIG. 4 is an elevation of a ceramic die according to this invention in a press and showing an alternate arrangement for locating the gas line.

To prolong the life of the die, a frame-shaped contact surface cover 42 of 1/10" thick steel sheet metal, shown in FIG. 4, is placed between the contact surface 31 and the workpiece 32. The contact surface cover 42 prevents the work piece 32 from sticking to or bonding with the ceramic contact surface on the underside of the lid 34.

The die base 30 has side surfaces 43 that are angled in at a taper angle 48 of at least 2 degrees, preferrably about 5 degrees. The taper angle has been found to work well with the ceramic material by distributing the compressive force exerted by the press platens on the die in such a way that the ceramic walls of the die base 30 can best withstand the compressive loading, and the compressive loading tends to counteract the bursting forces exerted by the gas pressure through the workpiece 32 on the walls of the die base 30. The die built with such tapering sides 43 will last longer than a similar straight-sided die.

A ceramic lid 44 for the die 30, as shown in FIG. 2, may be cast directly to the contact surface 31 of the die base 30 to optimize fit. The die base 30 and die lid 44 should be aligned and in contact during the curing process. The contact surface of the die base 31 and die lid 44 need not be coplanar when a ceramic lid 44 is used. This non-coplanar feature is most common either where a sealing bead 47 runs along the sealing surface of the die base 30, or where a more substantial part pre-form bend 46 is desired. A pre-form bend 46 is used to accomodate high contour forming while avoiding over straining the part in the superplastic process.

As shown in FIG. 3, a self supporting ceramic die having a ceramic die base 30 and a ceramic die lid 44 offers the capability to integrate numerous useful features directly into the die. Superplastic forming die use requires placing the die into a press. By casting through holes 49 directly into the die base 30 or lid 44, metal rods 50 of a smaller diameter than the through holes 49 may be easily inserted into the holes 49 and provide a safe lifting point for transporting the die. It is also possible to cast heating elements 51 directly into the die base 30 and/or die lid 31. At a suitable time in the forming cycle, gas, typically argon, is forced into the die through a conduit 37 cast in the lid. A simple "S" shaped bend 52 is placed in the conduit 37 prior to casting it in the die. This "S" bend 52 helps ensure both an accurate location of the conduit 37 and a pressure tight seal that prevents the pressurized gas from escaping from the die cavity 35 between the conduit 37 and the die lid 44. When the workpiece 32 has taken the shape of the die cavity 35, the formed work piece and die base 30 often have so substantially the same shape that extracting the workpiece is difficult and may result in damage to the die base 30. Thus, pry slots 53 are located in the die base 30 to enable the operator to more easily extract the formed workpiece from the die base 30.

As shown in FIG. 4, a die is loaded into a press 54 for the superplastic forming operation. The die lid 44 is affixed to an upper platen 55 of the press, and the die base 30 to the lower platen 56. The ceramic die lid 44 has clamping pockets 57 cast into it which allows clamps 58 to mount the die lid 44 directly to the upper platen 55. Similarly, the die base 30 is affixed to the lower platten 56 using clamps 58 which attach in clamping pockets 57. The upper platen 55 may be raised along the Y axis to allow an operator (not shown) to position a work piece 32 between the die base 30 and die lid 44. The upper platen 55 is then lowered and compressively loaded, trapping the work piece 32 securely between the die base's contact surface 31 and the lid's contact surface 45.

FIG. 4 also shows an alternative method for locating a gas pressure conduit 37. Where a contact surface cover 42 is located on the die base's contact surface 31, if a section of the contact surface cover 42 about the width of the conduit 37 is removed to leave a gap, the conduit 37 may be placed in the gap to supply pressurized gas to the forming chamber 35.

Figure 5:
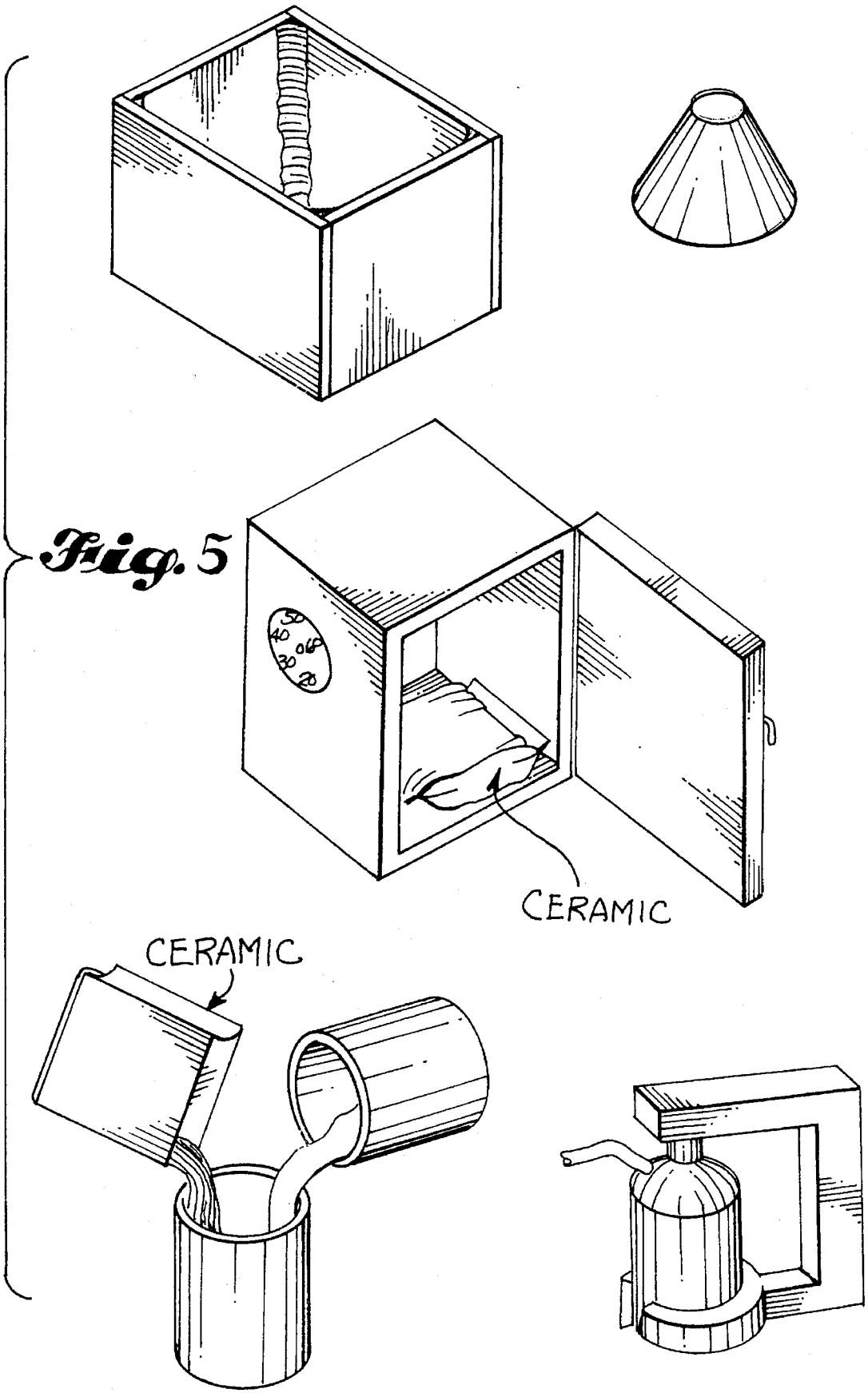
FIG. 5 is a schematic diagram showing the initial steps used to make the ceramic die according to this invention.
Figure 6:
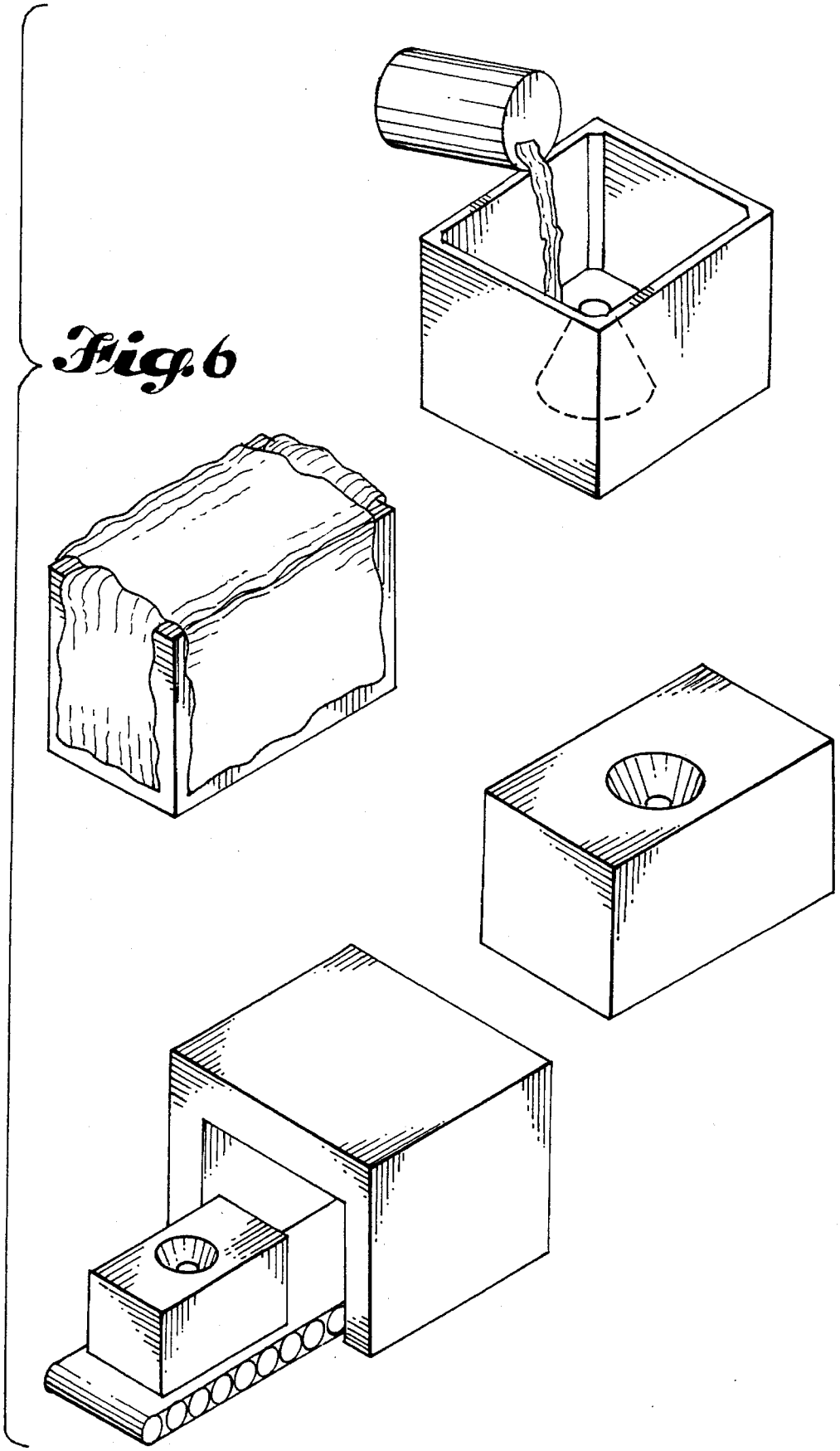
FIG. 6 is a schematic diagram showing the final steps to make the ceramic die according to this invention.

Successful manufacture of a self supporting ceramic superplastic forming die is facilitated by providing a method for increasing the structural integrity of the cast ceramic, because the resulting die must repeatably undergo superplastic forming loading conditions. This invention discloses a multi-step die design and manufacture process as shown in FIG. 5. These steps, taken in combination, and to a lesser extent independently, reduce the onset of ceramic die fracture and ultimately make possible fabrication of a ceramic superplastic forming die with the necessary structural characteristics to withstand repeated superplastic forming pressure cycles.

Successful manufacture of a ceramic superplastic forming die which is sufficiently fracture resistant is the product of numerous developments. These developments can be classified under four general catagories: mold production, ceramic preparation, ceramic pouring, and ceramic curing. Self supporting ceramic dies, successfully produced in sizes up to six feet by twelve feet by four feet, include design and process features which reduce the potential for die fracture. The overall die ratio of maximum length to minimum width or height should avoid exceeding 5:1. Larger ratios tend to increase the probability of die warpage and consequent internal loads during die compression which induce fractures. Because the ceramic die will shrink slightly during curing, it is important to avoid die designs which could crack the die as the die cures around the mold. Compression blankets placed strategically around the mold to accomodate the shrinkage can reduce the incidence of die cracking due to shrinkage onto the mold. The actual amount of ceramic shrinking will vary depending on which ceramic is selected, but should be readily available from the ceramic manufacturer.

Catastrophic decompression cavities 60 or "blow-out ports" shown in FIGS. 3 and 4 are designed into the bottom external surface 39 of the die which insure that the minimum die wall thickness is adjacent to the cavity. Because die fracture is most likely to occur between the die forming cavity and the decompression cavity, the decompression cavity will provide a safe pathway for release of gas forming pressure in the event of catastrophic die failure. While this method of releasing die pressure will result in the complete destruction of the die, it will do so in a manner which posses no hazard to proximately located people or equipment.

Decompression cavities 60 serve a second critical function: they greatly improve the dimensional stability of the die during the curing process. The ceramic curing process is exothermic and causes the center of a large mass of ceramic to cure at a significantly different rate from the periphery. Different curing rates can generate internal stresses which can induce cracks in the die. Thus, decompression cavities 60 should be liberally designed into the die's lower external surface. These cavities should use a draft angle of two to five degrees to facilitate removal of the die from the mold cavity.

After properly designing a ceramic die, a suitable forming cavity model and periphery mold is constructed. Some die designs cause the ceramic to tear itself apart as it shrinks during the curing process. I believe this occurs because the curing ceramic is shrinking circumferentially around a mold feature. A deformable material such as rolled modelling clay, or a compressible material such a Styrofoam is strategically placed into the model to allow the ceramic to shrink without cracking.

Porous models are typically made of plaster or wood and should be sealed to create a nonporous surface. This is done to limit the ceramic die from curing to and physically bonding with the mold and model. Automotive body filler materials have been found to make excellent sealing agents.

A peripheral containment system (a mold) is constructed into which the castable ceramic is poured. Plywood works adequately and allows simple location of features such as clamping pockets, aligning points, heating element forms, lifting hole forms, vent path forms, or other features. The internal corners of the mold are radiused to 0.5 inches or larger. Sealing material is applied to the entire internal surface of the mold to allow the mold to be removed from the cast die with a minimum amount of force. All surfaces which will be in contact with the castable ceramic are sealed and then treated with a parting agent. Although a wide variety of parting agents are available, Lemon scented Pledge® furniture polish has been found to be highly effective.

Once the mold is prepared, the ceramic castable must be properly mixed. A suitable ceramic material for the die 30 has been found to be a fused silica aggregate and calcium aluminate binder. A suitable material should have a compressive strength of at least 3000 psi, a minimum modulus of rupture of 800 psi, a linear coefficient of thermal expansion for temperatures ranging from 0° F. to 1800° F. of $0.44\times10^{-6}$ to $0.60\times10^{-6}$ in/in/° F., a minimum linear shrink factor of −0.6%, and a maximum operating temperature of at least 1900° F. Materials meeting these criteria include Pyromedia HS2, Thermosil 120, and Thermosil 220. The ceramic material should be cast into a die or discarded within one year of its original manufacture date to avoid hygroscopic degradation.

It is desirable to extend the curing process to ensure that the ceramic cures as uniformly and with as little internal stress as possible to minimize the possibility for die cracking. The curing process can be extended by extending the working life of the castable ceramic, the period between mixing and curing, and that can be extended by cooling the ceramic prior to mixing it with water. Cooling to about forty degrees Fahrenheit has been very effective in extending the working life of the castable ceramic. The castable ceramic is now mixed with cold water using ratios of ceramic to water as defined by the ceramic manufacturer.

Because any air-bubbles in the die will act as stress concentration points, care should be taken to reduce the potential for trapping air in the ceramic while it is still liquid. Three techniques have proven effective in substantially reducing the presence of air trapped in ceramic dies. First, the ceramic is mixed under vacuum, both to draw as much air out of the liquid ceramic as possible and to avoid cavitation during the mixing process which normally traps air in the ceramic. Second, the liquid ceramic is poured into the mold slowly, to prevent trapping air in the mold; however, the total pour time should not exceed forty-five minutes. Third, the mold is vibrated during and/or after pouring to promote migration of trapped air up through the liquid ceramic and out of the die. The ceramic may be vibrated with vibrating probes and/or vibrators attached to the construction table.

After the poured die has set for approximately four to six hours, the decompression cavity models and the mold should be removed. It is during this time that it is desirable to prolong the curng cycle. The curing cycle can be extended by covering the die with wet cloths and plastic sheet. As the water migrates out of the die, the plastic tends to trap the water on the surface of the die and reduce the rate of evaporation, thereby increasing the curing time. After the die has returned to room temperature which typically takes a period of about a day, depending on die size, the die is hot air dried at about 150° F. for about five days and finally sintered in an oven progressively elevating the temperature from 150° F. to approximately 1800° F. over a period of about a day. The sintering process should elevate the temperature slowly at the vapor temperature of water and solvents, about 220° F. and 1050° F. to prevent stressing the die by vaporizing fluid too rapidly or while it is contained in the die.

When a die is intended to be used with a ceramic lid, the lid and the die should be cured together to insure optimum fitup between the die and lid at the seal surfaces. When a die is intended to be used with a CRES lid, after the die is cured, the contact surface and lower external surface should be ground flat and parallel. A layer of mortar mix about one half inch thick is then be applied to the bottom of the die, a steal plate laid over the mortar, and the lid, die, mortar, and steal plate are loaded into the press while the mortar cures. This will insure that uniform loads are applied to the seal surfaces when the die is used.

One skilled in the art may conceive ways to vary, modify, or adapt the preferred embodiment disclosed herein. Therefore, it is to be understood that these variations, modifications, and adaptations may be practiced while remaining within the spirit and scope of this invention as defined in the following claims, wherein

I claim:

1. A superplastic forming die comprising:

a free standing, self-supporting, generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die;

a die lid having a horizontal cross sectional shape and size at least large enough to cover said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when under pressure of compressive loads exerted by said press, to resist internal bursting forces exerted by gas at superplastic forming pressures within said die, whereby said forming die may be safely used in said press to make superplastic formed parts free of an enclosing containment vessel around said forming die.

2. A forming die as defined in claim 1 wherein:

said lid is made of corrosion resistant steel.

3. A forming die as defined in claim 1 wherein:

said lid is made of ceramic material.

4. A forming die as defined in claim 3 wherein:

said lid and die have a substantially common contact surface which lies in a single geometric plane.

5. A forming die as defined in claim 3 wherein:

said lid and die have a substantially common contact surface which projects out of a single geometric plane;

said non-planar geometry comprising a ridge in said contact surface surrounding said forming cavity.

6. A forming die as defined in claim 3 wherein:

said lid and die have a substantially common contact surface which projects out of a single geometric plane and constitutes non-planar geometry comprising a distortion of said contact surface.

7. A forming die as defined in claim 6 wherein:

said heating element is selected from the group including heating cartridges, resistance wires, quartz lamps, induction heating coils, and magnetic heating coils.

8. A forming die as defined in claim 1 wherein:

said ceramic material has a flexural strength of at least approximately 500 psi, a compressive strength of at least approximately 2000 psi, a coefficient of thermal expansion of no greater than approximately $0.70\times10^{-6}$ in/in/° F., and a maximum operating temperature of at least approximately 2000° F.

9. A forming die as defined in claim 8 wherein:

said ceramic material is selected from the group including Pyromedia HS2, Thermosil 120, and Thermosil 220.

10. A forming die as defined in claim 1 additionally comprising:

a source for pressurized gas;

a conduit passing through said die supplying pressurized gas from said source to said forming cavity.

11. A forming die as defined in claim 1 wherein:

said die forming cavity has a generally cylindrical hole extending from said forming cavity through said die to said die's exterior side, said hole being a vent port.

12. A forming die as defined in claim 1 further comprising:

a continuous piece of sheet steel of thickness between approximately 0.07 and 0.20 inches, said sheet of material being a contact surface cover, said cover being placed upon said die's contact surface, and covering substantially only said die's contact surface.

13. A forming die as defined in claim 1 additionally comprising:

a source for pressurized gas;

a conduit for supplying said pressurized to said die cavity;

a contact surface cover as defined in claim 12, wherein said contact surface cover has a local discontinuity approximately normal to said cover's edge, said discontinuity exposing said contact surface, said discontinuity being at least approximately as wide as said conduit, but being not more than approximately three-tenths of an inch wider than said conduit;

said conduit being placed into said discontinuity.

14. A forming die as defined in claim 1 wherein:

a heating element is at least partially embedded into said die.

15. A superplastic forming die, comprising:

a free standing generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die;

a die lid having a horizontal cross sectional shade and size approximately equal to said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when in pressure of compressive loads exerted by said press, to resist internal bursting forces exerted by gas at superplastic forming pressures within said die;

a source for pressurized gas;

a conduit passing through said die, for supplying pressurized gas from said source to said forming cavity, said conduit is formed having a plurality of discrete angular bends normal to said conduit's primary axis, said conduit having a coefficient of thermal expansion, and said ceramic also having a coefficient of thermal expansion, said coefficient for ceramic being substantially smaller than said coefficient for said conduit;

said conduit being embedded in said ceramic material, said superplastic forming including substantially elevating said die temperature, said die and said embedded conduit being heated during said superplastic forming process;

said heat causing said conduit to expand at a rate different from said ceramic, said differential expansion causing said conduit to apply sealing force to said ceramic at said discrete angular bends.

16. A forming die as defined in claim 15 wherein:

said plurality of discrete angular bends normal to said conduit's primary axis generally comprising an 'S' shape.

17. A superplastic forming die, comprising:

a free standing generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die, said die base has sides which taper from said base top surface outward to said base bottom surface at a taper angle at least two degrees;

a die lid having a horizontal cross sectional shape and size approximately equal to said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when in pressure of compressive loads exerted by said press, to resist internal bursting forces exerted by gas at superplastic forming pressures within said die.

18. A forming die as defined in claim 17 wherein:

said taper angle is approximately five degrees.

19. A superplastic forming die, comprising:

a free standing generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die;

a die lid having a horizontal cross sectional shape and size approximately equal to said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when in pressure of compressive loads exerted by said press to resist internal bursting forces exerted by gas at superplastic forming pressures within said die;

said die forming cavity has a generally cylindrical hole extending from said forming cavity through said die to said die's exterior side, said hole being a vent port;

said vent port has an orifice in said forming cavity which is approximately one-half the surface area of said vent port orifice in said exterior side.

20. A superplastic forming die, comprising:

a free standing generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die;

a die lid having a horizontal cross sectional shape and size approximately equal to said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when in pressure of compressive loads exerted by said press to resist internal bursting forces exerted by gas at superplastic forming pressures within said die;

said die forming cavity has a generally cylindrical hole extending from said forming cavity through said die to said die's exterior side, said hole being a vent port; said vent port has a generally circular cross section, said cross section having a diameter at said exterior side of approximately one-quarter of an inch, said orifice having a diameter at said forming die cavity of approximately one-eighth of an inch.

21. A superplastic forming die, comprising:

a free standing generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die;

a die lid having a horizontal cross sectional shape and size approximately equal to said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when in pressure of compressive loads exerted by said press to resist internal bursting forces exerted by gas at superplastic forming pressures within said die;

a cavity in said die's lower external surface, said cavity being a blow-out cavity; said blow-out cavity being located approximately under said forming cavity, said blow-out cavity having a depth into said die of at least approximately two inches, and a surface area on said die's lower external surface of between fifteen and one hundred square inches;

said die having a material thickness between said blow-out cavity and said forming cavity of between approximately four inches and two inches;

said blow-out cavity having a plurality generally cylindrical holes extending from said blow-out cavity to said die's exterior side, said holes being vent ports.

22. A superplastic forming die, comprising:

a free standing, self-supporting, generally block-shaped ceramic monolithic die base having a bottom surface on which said die rests, and a top surface, opposite to said bottom surface, in which a forming cavity is formed and which is surrounded by a contact surface, said forming cavity having a shape like the desired shape of sheet metal parts to be formed by superplastic forming in said die;

a die lid having a horizontal cross sectional shape and size sufficiently large to cover said die base, and having a contact surface corresponding in size and contour to said die base contact surface, whereby said lid is placed on said base with said contact surfaces aligning and in contact;

said die base being formed of a ceramic material that provides sufficient compressive strength to resist a compressive load exerted by a press to hold said lid on said die against oppositely directed force generated by gas at superplastic forming pressures within said die, and provides sufficient tensile strength, when in pressure of compressive loads exerted by said press to resist internal bursting forces exerted by gas at superplastic forming pressures within said die;

a blow-out cavity in said bottom surface of said die base located approximately under said forming cavity, said blow-out cavity having a draft angle of at least 2 degrees and a depth into said die sufficiently deep so that the minimum thickness of said die base is at said cavity to ensure that any catastrophic decompression for said die base occurs at said blow-out cavity.

* * * * *